US005494334A

United States Patent [19]

Zvonik

[11] Patent Number: 5,494,334

[45] Date of Patent: Feb. 27, 1996

[54] FOOTREST ASSEMBLY FOR A SALON CHAIR

[76] Inventor: Rosa L. Zvonik, 3377 Bee Ridge Rd., C-1, Sarasota, Fla. 34239

[21] Appl. No.: 291,139

[22] Filed: Aug. 16, 1994

[51] Int. Cl.[6] ..... A47C 7/50

[52] U.S. Cl. ..... 297/423.25; 297/423.29; 297/423.35; 297/344.19

[58] Field of Search ..... 297/344.19, 423.1, 297/423.2, 423.25, 423.26, 423.29, 423.34, 423.35, 423.39, 423.40, DIG. 4

[56] References Cited

U.S. PATENT DOCUMENTS 3,257,148 6/1966 Menuto ..... 297/423.29
3,891,270 6/1975 Crossman et al. ..... 297/423.1 X
4,592,562 6/1986 Strautnieke et al. ..... 297/DIG. 4 X
5,333,887 8/1994 Luther ..... 297/DIG. 4 X

*Primary Examiner*—Peter R. Brown
*Attorney, Agent, or Firm*—Charles J. Prescott

[57] ABSTRACT

An improved footrest assembly for a salon chair which replaces a standard one-piece U-shaped tubular footrest. By providing pivotally mounted foot plates on a unique yet simple tubular frame having spaced supports which connect to existing mounting holes of a lower surface of the seat of the salon chair, a user, especially an elderly person, may much more easily get to and from a seated position in the salon chair with the foot plates pivoted up. After being seated in the salon chair, the foot plates are easily pivoted downward to a horizontal position for foot support.

3 Claims, 1 Drawing Sheet

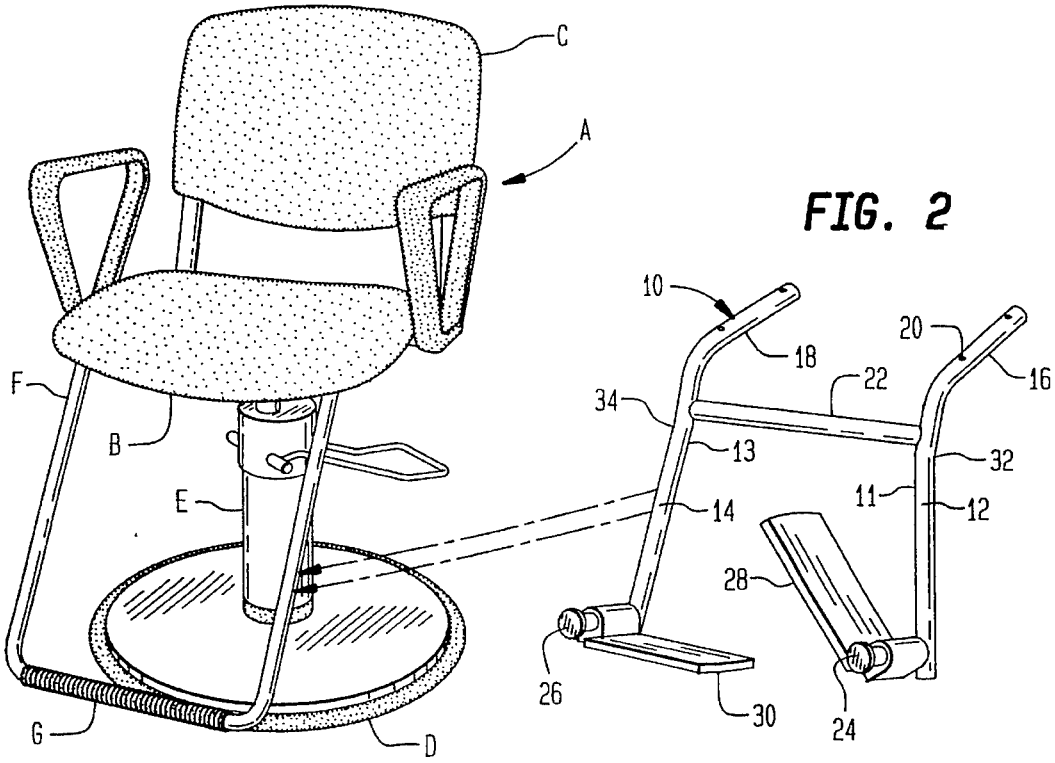
FIG. 2
FIG. 1
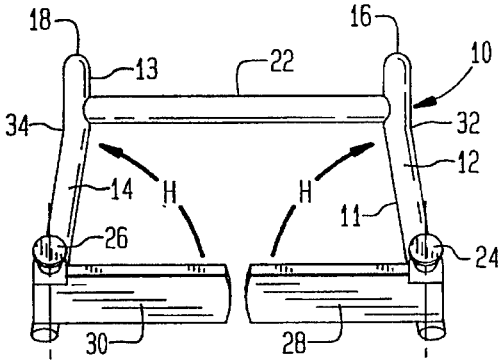
FIG. 3
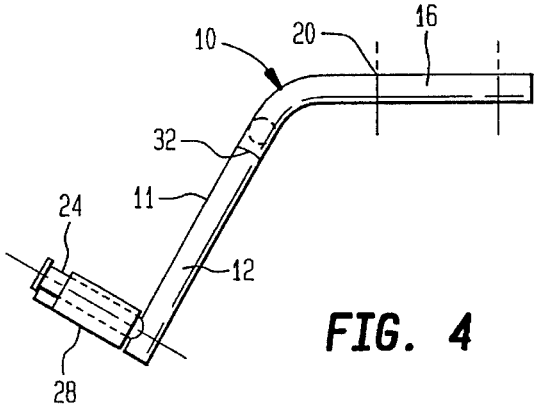
FIG. 4

FOOTREST ASSEMBLY FOR A SALON CHAIR

BACKGROUND OF THE INVENTION

1. Scope of Invention

This invention relates generally to salon or styling chairs, and more particularly to a footrest assembly with pivotal foot plates which replaces a conventional rigid tubular one-piece footrest of such salon chairs.

2. Prior Art

Salon or styling chairs are widely used by beauticians and other individuals performing a service for someone seated in such chairs. A typical salon chair having a rigid tubular U-shaped footrest is depicted in U.S. Pat. No. 4,995,670 invented by Rodas. This patent additionally teaches a circular hairdresser footrest which is connectable around the base of the salon chair for supporting the hairdresser's foot while working on a customer seated in a salon chair.

However, in order to take a seated position in these prior art salon chairs, the user must either step over the horizontal foot-engaging and supporting portion of the rigid U-shaped footrest or stand in front of the salon chair with the backs of the ankles against the horizontal foot engaging portion and then literally fall backward into the chair. Users with ambulatory problems, particularly the elderly, have a great deal of difficulty both getting into and out of these chairs because of the rigid immovable nature of these conventional footrests.

One attempt to address this problem is disclosed in U.S. Pat. No. 5,039,167 wherein Sweet has invented a movable footrest for handicap and styling chairs. This invention discloses a footrest pivotally mounted along the central longitudinal axis of the chair wherein the footrest assembly pivots rearward out of the way while the user is either being seated or getting up from the salon chair. However, the complexity of this invention is somewhat discouraging to economical manufacture thereof.

Another attempt to address to address this problem generally is shown by Sharff in U.S. Pat. No. 4,358,156 teaching a chair for the handicapped and invalids with an adjustable pivotable footrest which can be positioned in useful or out-of-the-way positions. Here again, the Sharff device is somewhat structurally complex and not well adapted for connection to a salon chair.

Incorporated into the present invention is a wheelchair footrest as shown in U.S. Pat. No. 3,990,744 invented by Rodaway which provides a pivotally mounted footrest 12 held for pivotal motion only on an elongated journalling tube 16 connected at one end and forwardly extending from a lower end of an elongated support tube 13.

A number of other uniquely configured footrests are shown in the following U.S. Patents:

U.S. Pat. Nos.

4,114,613 Kuhn
4,277,660 Lemmer
5,201,568 Christensen, Jr.
5,259,664 Cottle
4,538,857 Engman The present invention provides a simple and economical to manufacture footrest assembly which is connectable directly onto a bottom surface of an existing salon chair after removal of the conventional U-shaped rigid footrest. Thus, when the invention is installed onto a conventional salon chair, the user may walk directly up to and be seated atop the salon chair without being concerned with either tripping over the horizontal foot support portion of the conventional footrest or having to free-fall backwards into the salon chair.

BRIEF SUMMARY OF THE INVENTION

This invention is directed to an improved footrest assembly for a salon chair which replaces a standard one-piece U-shaped tubular footrest. By providing pivotally mounted foot plates on a unique, yet simple tubular frame with spaced opposing supports which connect to existing mounting holes of a lower surface of the seat of the salon chair, a user, especially an elderly or ambulatory-impaired person, may much more easily get into and from a seated position in the salon chair with the foot plates pivoted up into a non-use position. After being seated in the salon chair, the foot plates are easily pivoted downward to a horizontal useful position for foot support.

It is therefore an object of this invention to provide a footrest assembly for use in conjunction with a salon or styling chair which is better adapted for use by the elderly and those with ambulatory impairments.

It is yet another object of this invention to provide a footrest assembly which may be conveniently installed onto the seat of a conventional salon or styling chair after removal of the conventional rigid U-shaped tubular footrest.

It is yet another object of this invention to provide an economical to manufacture footrest assembly having pivotal foot plates for use in conjunction with a conventional salon or styling chair.

In accordance with these and other objects which will become apparent hereinafter, the instant invention will now be described with reference to the accompanying drawings.

BRIEF DESCRIPTION OF THE DRAWINGS

FIG. 1 is a perspective view of a conventional prior art salon or styling chair.

FIG. 2 is a perspective view of the invention which replaces the conventional rigid tubular footrest F shown in FIG. 1.

FIG. 3 is a front elevation view of FIG. 2.

FIG. 4 is a right side elevation view of FIG. 2.

DETAILED DESCRIPTION OF THE INVENTION

Referring now to the drawings, a conventional salon or styling chair is shown in FIG. 1 generally at A. This salon chair A includes a horizontal seat B from which depends an upright seat back C. A circular base D grippingly engages a horizontal floor surface and supports the seat B and back C by pedestal E therebetween. To support the user's feet, a generally U-shaped rigid tubular footrest F is also provided connected at each formed end thereof to the bottom surface of seat B as shown. This rigid footrest F includes a horizontal foot supporting portion G which is elevated above the floor surface.

As will be appreciated with respect to this prior art salon chair A of FIG. 1, a user must either step over the horizontal foot support portion G to be positioned for seating within the salon chair A, or by standing with the foot support portion G at the user's ankle backs and the salon chair A positioned directly behind, the user then simply falls into the salon chair A.

The present invention is shown generally at numeral 10 in FIGS. 2, 3 and 4. As seen in FIG. 2 by the phantom arrow toward FIG. 1, the invention 10 is intended to entirely replace the conventional rigid footrest F.

The invention 10 includes a pair of rigid tubular supports 11 and 13 each having a somewhat forwardly sloping but generally upright leg 12 and 14, respectively and generally horizontal legs 16 and 18, respectively. Each of these tubular supports 11 and 13 are spaced apart and rigidly held in opposing fashion by a rigid tubular cross bar 22. Each of the horizontal legs 16 and 18 include mounting holes 20 (typ.) which preferably mate with the exiting mounting holes and associated threaded fasteners to be found in the bottom of the seat B to facilitate direct mounting of the device after removal of the conventional rigid footrest F.

A pair of foot plates 28 and 30 are pivotally supported on a forwardly extending tubular foot plate mount or journalling tube 24 and 26, respectively. Each of the foot plate mounts 24 and 26 are connected to, and depend from, adjacent the lower ends of each of the upright legs 12 and 14, respectively.

As best seen in FIG. 2 and 4, then, each of the foot plates 28 and 30 may be pivoted either by foot or by hand from an in-use horizontal position upwardly in the direction of arrows H to an upright out-of-the-way or non-use position against the upright legs 12 and 14. By this arrangement, the elderly and ambulatory-impaired users may easily step up the salon chair A for seating when the foot plates 28 and 30 are in the upright non-use position and then they, themselves or an assistant may then pivot the foot plates 28 and 30 downwardly into the horizontal in-use position.

Although it is preferred that the present invention be utilized as a replacement for the conventional rigid footrest F of an existing salon chair A, it should be clear that salon chairs may include this invention during original manufacture as well. Further, an owner of an existing salon chair A may gain economic advantage by having the conventional rigid footrest F remanufactured into the invention 10 as shown in FIG. 2 by an authorized fabricator so as to reduce the overall manufacturing costs and to facilitate reinstallation of the device 10.

When the foot plates 28 and 30 are in an upright non-use position, the width therebetween is somewhat reduced due to the thickness of these foot plates 28 and 30. To increase this width to provide more foot room and standing room for the user, each of the upright legs 12 and 14 are laterally splayed or canted opposingly away from one another at 32 and 34. This angularity between the upright legs 12 and 14 both accommodates a longer length for the foot plates 28 and 30 and provides additional standing space for the user when entering and exiting from the salon chair A.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A footrest assembly for a salon chair comprising:

a pair of rigid elongated laterally spaced tubular supports each having a generally horizontal leg thereof and a downwardly sloping somewhat upright leg thereof;

a horizontal crossbar rigidly connected at each end thereof to adjacent an upper end of each said upright leg wherein said supports are securely spaced apart and in opposing alignment one to another when viewed from a side of said assembly;

a tubular foot plate support connected at one end thereof to adjacent a lower end of each said upright leg and forwardly extending therefrom to terminate at a free end of each said foot plate support;

a foot plate mounted for pivotal movement along an outer margin thereof on each said foot plate support about a longitudinal axis thereof between a generally horizontal in-use position and an upright non-use position against one said upright leg;

each said horizontal leg having mounting hole means formed therein for facilitating connection of said assembly to a bottom surface of a seat portion of the salon chair;

said horizontal legs extending generally parallel to one another and each said upright leg below said crossbar extending outward laterally down to the corresponding said foot plate support to provide additional walking clearance to and from the salon chair when said foot plates are in the upright non-use position.

2. A footrest assembly in combination with a salon chair, said footrest assembly comprising:

a pair of rigid elongated laterally spaced tubular supports each having a generally horizontal leg thereof and a downwardly sloping somewhat upright leg thereof;

a horizontal crossbar rigidly connected at each end thereof to adjacent an upper end of each said upright leg wherein said supports are securely spaced apart and in opposing alignment one to another when viewed from a side of said assembly;

a tubular foot plate support connected at one end thereof to adjacent a lower end of each said upright leg and forwardly extending therefrom to terminate at a free end of each said foot plate support;

a foot plate mounted for pivotal movement along an outer margin thereof on each said foot plate support about a longitudinal axis thereof between a generally horizontal in-use position and an upright non-use position against one said upright leg;

each said horizontal leg having mounting hole means formed therein for facilitating connection of said assembly to a bottom surface of a seat portion of said salon chair.

3. A footrest assembly as set forth in claim 2, wherein:

each said upright leg extends outward laterally below said crossbar to provide additional walking clearance to and from the salon chair when said foot plates are in the upright non-use position.

* * * * *

UNITED STATES PATENT AND TRADEMARK OFFICE

CERTIFICATE OF CORRECTION

PATENT NO. : 5,494,334

DATED : February 27, 1996

INVENTOR(S) : Rosa Lee Zvonik

It is certified that error appears in the above-identified patent and that said Letters Patent is hereby corrected as shown below:

On the title page, item [76] Inventor: "Rosa L. Zvonik" should read --Rosa Lee Zvonik-- as shown on the attached title page.

Signed and Sealed this

Fourth Day of June, 1996

*Attest:*

*Attesting Officer*

BRUCE LEHMAN

*Commissioner of Patents and Trademarks*

United States Patent [19]

Zvonik

[11] Patent Number: 5,494,334

[45] Date of Patent: Feb. 27, 1996

[54] FOOTREST ASSEMBLY FOR A SALON CHAIR

[76] Inventor: Rosa Lee Zvonik, 3377 Bee Ridge Rd., C-1, Sarasota, Fla. 34239

[21] Appl. No.: 291,139

[22] Filed: Aug. 16, 1994

[51] Int. Cl.° ..... A47C 7/50

[52] U.S. Cl. ..... 297/423.25; 297/423.29; 297/423.35; 297/344.19

[58] Field of Search ..... 297/344.19, 423.1, 297/423.2, 423.25, 423.26, 423.29, 423.34, 423.35, 423.39, 423.40, DIG. 4

[56] References Cited

U.S. PATENT DOCUMENTS

| | | | |
|---|---|---|---|
| 3,257,148 | 6/1966 | Menuto | 297/423.29 |
| 3,891,270 | 6/1975 | Crossman et al. | 297/423.1 X |
| 4,592,562 | 6/1986 | Strautmieke et al. | 297/DIG. 4 X |
| 5,333,887 | 8/1994 | Luther | 297/DIG. 4 X |

*Primary Examiner*—Peter R. Brown

*Attorney, Agent, or Firm*—Charles J. Prescott

[57] ABSTRACT

An improved footrest assembly for a salon chair which replaces a standard one-piece U-shaped tubular footrest. By providing pivotally mounted foot plates on a unique yet simple tubular frame having spaced supports which connect to existing mounting holes of a lower surface of the seat of the salon chair, a user, especially an elderly person, may much more easily get to and from a seated position in the salon chair with the foot plates pivoted up. After being seated in the salon chair, the foot plates are easily pivoted downward to a horizontal position for foot support.

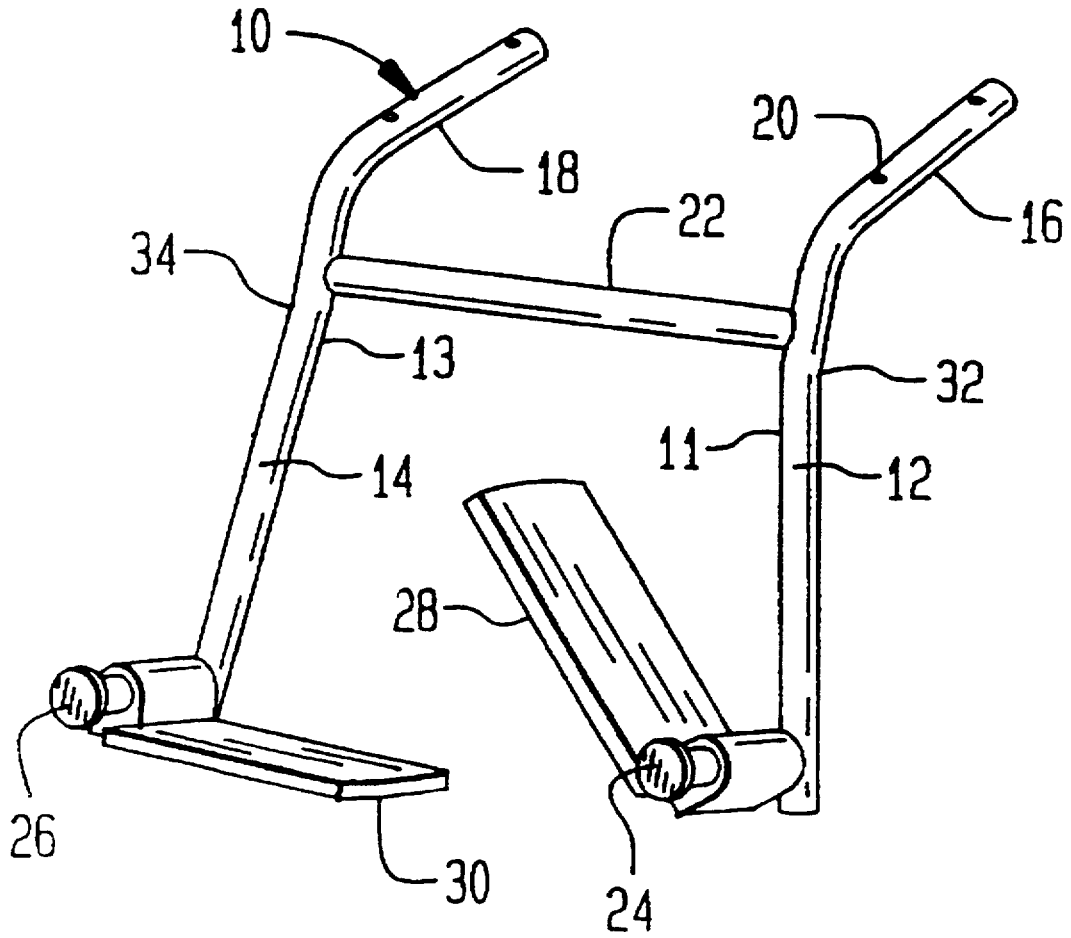

3 Claims, 1 Drawing Sheet